US007955107B1

(12) United States Patent
Pao et al.

(10) Patent No.: US 7,955,107 B1
(45) Date of Patent: Jun. 7, 2011

(54) CONNECTOR STRUCTURE

(75) Inventors: Chung-Nan Pao, Taipei Hsien (TW); Po-Shen Chen, Wugu Township, Taipei County (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 12/826,903

(22) Filed: Jun. 30, 2010

(30) Foreign Application Priority Data

Mar. 31, 2010 (TW) ..... 99205640 U
Mar. 31, 2010 (TW) ..... 99205645 U

(51) Int. Cl.
*H01R 12/24* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 7,291,040 B2 * 11/2007 Kato ..... 439/495
7,318,737 B2 * 1/2008 Yokoyama ..... 439/260
7,390,213 B2 * 6/2008 Iino et al. ..... 439/495
2002/0081884 A1 * 6/2002 Asai ..... 439/260
2007/0141896 A1 * 6/2007 Huang et al. ..... 439/495

FOREIGN PATENT DOCUMENTS

TW M359065 6/2009

* cited by examiner

*Primary Examiner* — Gary F. Paumen

(74) *Attorney, Agent, or Firm* — Kile Goekjian Reed & McManus PLLC

(57) ABSTRACT

A connector structure, accommodating a flat cable via a front end thereof is disclosed. The flat cable defines a recess at each lateral side thereof; and the connector structure includes a connection base, a lid member, a plurality of terminals, and a pair of latch members being made of metallic materials. The connection base has a base portion, a pair of sidewalls extending backwards from two lateral sides of the base portion respectively. The lid member includes a pair of pivotal shafts pivoted respectively to the sidewalls of the connection base, and a pair of brake shafts each being adjacent to an inner side of each pivotal shaft. Each of the latch members is secured to each sidewall of the connection base, and has a latch arm. After the lid member covers over, the brake shafts actuate the latch arms in order to engage the recesses of the flat cable.

20 Claims, 11 Drawing Sheets

CONNECTOR STRUCTURE

BACKGROUND OF THE INVENTION

1. Field of the Invention

The present invention relates to a connector structure; in particular, to a connector structure, which electrically connects a resilient flat cable for providing means for securing the flat cable.

2. Description of Related Art

The connector, an electrical connection device used for connection between a cable, a circuit board or other electronic component, is applied broadly to various electronic products, such notebook or PDA.

A conventional connector for securing a resilient flat cable, for example, disclosed in R. O. C. Patent No. M359065, defines a pair of fix blocks projected from a plastic base, and further defines a pair of fix holes formed at lateral sides of the flat cable to mate the fix blocks for secure.

However, this type of connector is of being small size, the structure of the fix block is not strong enough and is damaged easily due to external resistance, and it brings to the flat cable departs from the connector. Besides, the consideration of configuration regarding the fix blocks makes the mold of the plastic base more challenge.

SUMMARY OF THE INVENTION

The object of the present invention is to disclose an connector structure is disclosed. The issue is to create a displaying portion to exhibit some contents for user reading and studying, and to create a writing portion to offer means for making notes during the study process.

In view of the aforementioned issues, a connector structure is disclosed. The issue is to create an excellent strengthens of means for connecting a flat cable therein and prevent the flat cable from departing the connector structure.

In order to achieve the aforementioned objects, according to the present invention, connector structure, accommodating a flat cable via a front end thereof; wherein the flat cable defines a recess at each lateral side thereof; and the connector structure includes a connection base, a plurality of terminals received in the connection base, a lid member pivoted to the connection base, and a pair of latch members. The connection base has a base portion, a pair of sidewalls extending backwards from two lateral sides of the base portion respectively, an expansion portion extending backwards from a bottom of the base portion, and a plurality of slots penetrating through the base portion and the expansion portion. The base portion defines an opening for forming a front-end face to accommodate the flat cable. The terminals are received respectively in the slots of the connection base. The lid member includes a pair of pivotal shafts pivoted respectively to the sidewalls of the connection base, and a pair of brake shafts each being adjacent to an inner side of each pivotal shaft. The latch members are made of metallic materials and secured respectively to the sidewalls of the connection base; each latch member has a foundation disposed at a bottom face of each sidewall, and a latch arm extending from the foundation into the opening of the connection base and further located beneath each brake shaft. Therefore, the brake shafts suppresses the latch arms in order to engage the recesses of the flat cable respectively, after the lid member covers over.

To achieve the above-mentioned objectives, the present invention provides a connector structure, accommodating a flat cable via a front end thereof; wherein the flat cable defines a recess at each lateral side thereof; and the connector structure includes a connection base, a plurality of terminals, a lid member, and a pair of latch members. The connection base has a base portion, a pair of sidewalls extending backwards from two lateral sides of the base portion respectively, a plurality of slots penetrating through the base portion, and a pair of reception slots formed by the outmost two slots respectively; the base portion defines an opening for forming a front-end face to accommodate the flat cable. The terminals are received respectively in the slots of the connection base. The lid member includes a pair of pivotal shafts pivoted respectively to the sidewalls of the connection base, and a pair of brake shafts, each being adjacent to an inner side of each pivotal shaft; each brake shaft is flat-column-shaped. The latch members are received respectively in the reception slots of the connection base, and each of the latch members locates at the same vertical face with the corresponding recess of the flat cable; each latch member includes a latch arm, a base arm and a link section connecting a mid of the latch arm to a mid of the base arm; a front end of each latch arm locates over the corresponding recess, and each brake shaft locates between a rear end of the latch arm and a rear end of the base arm. Therefore, each brake shaft lifts the rear end of the corresponding latch arm so that the front end of each latch arm engages the corresponding recess of the flat cable, after the lid member covers over.

There are some advantages disclosed in accordance with the present invention:

First, the structure for securing the flat cable is substantially strong: the latch member is used to engage with the flat cable, and the latch member is made of metallic materials.

Second, the procedure for secure of the flat cable is simplified: the brake shafts actuate the latch arms of the latch members in order to engage the flat cable, after the lid member covers over.

In order to further the understanding regarding the present invention, the following embodiments are provided along with illustrations to facilitate the disclosure of the present invention.

DETAILED DESCRIPTION OF THE PREFERRED EMBODIMENTS

Figure 1:
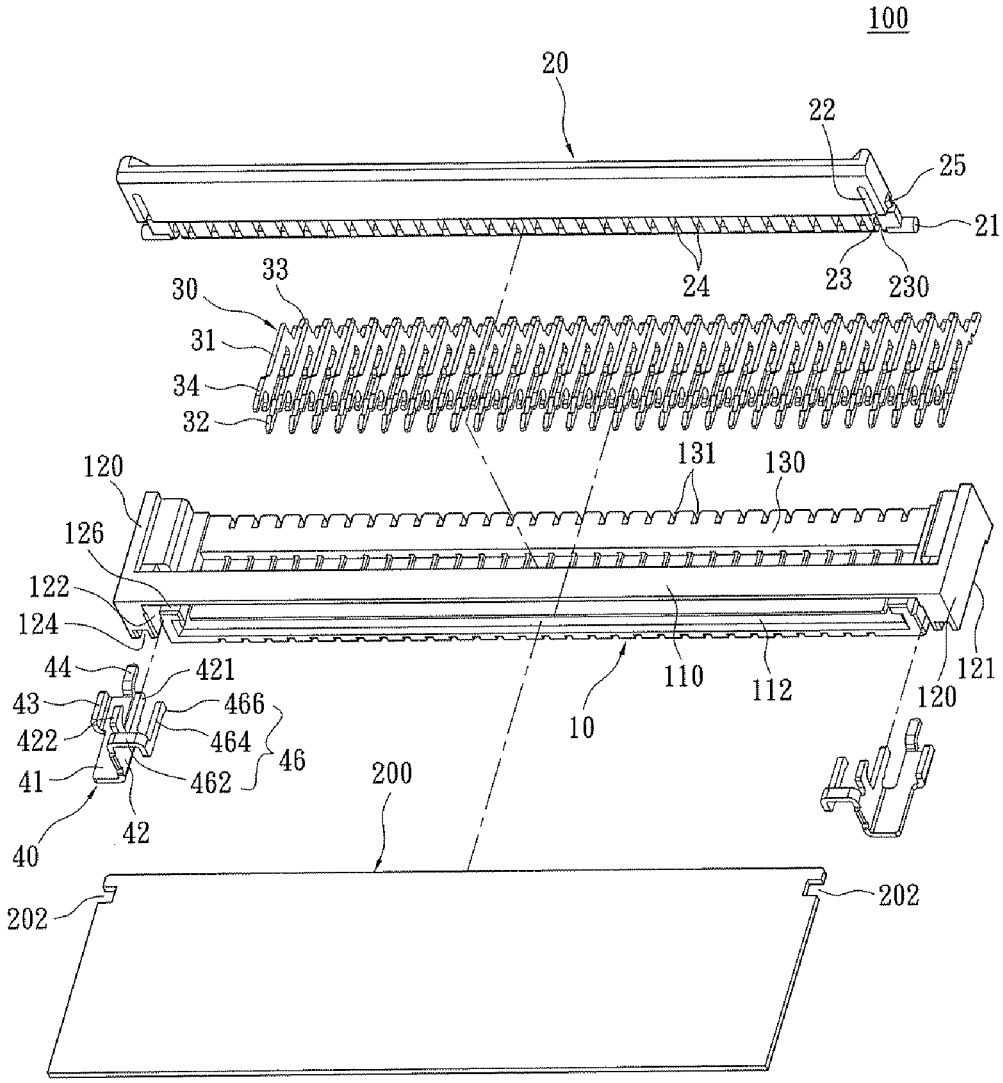
FIG. 1 shows a decomposition view of a connector structure in accordance with a first preferred embodiment according to the present invention.
Figure 2:
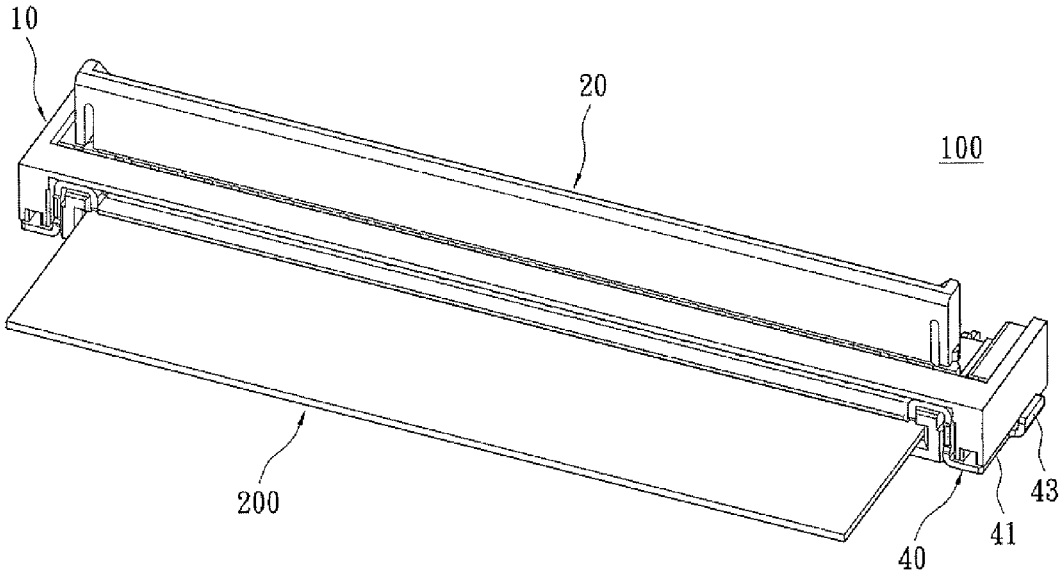
FIG. 2 shows a perspective view of the connector structure in accordance with the first preferred embodiment according to the present invention.

Referring now to FIGS. 1 and 2, in which a connector structure 100 in accordance with a first preferred embodiment according to the present invention is disclosed. The connector structure 100 is used for accommodating and electrically connecting a flat cable 200. The flat cable 200 is inserted from a front end of the connector structure 100; the flat cable 200 defines a recess 202 at each lateral side thereof, and has a bottom face exposing a plurality of conductive wires (not shown).

The connector structure 100 in accordance with the first preferred embodiment defines an end adjacent to the flat cable 200 as the front end thereof. The connector structure 100 includes a connection base 10, a lid member 20 pivoted to the connection base 10, a plurality of terminals 30 received in the connection base 10, and a pair of latch members 40 secured to two lateral sides of the connection base 10 respectively and further stretching forwards.

The connection base 10 includes a base portion 110, a pair of sidewalls 120 extending backwards from two lateral sides of the base portion 110 respectively, an expansion portion 130 extending backwards from a bottom of the base portion 110, and a plurality of slots 131 penetrating through the base portion 110 and the expansion portion 130. The base portion 110 defines an opening 112 for forming a front-end face to accommodate the flat cable 200.

The terminals 30 are received respectively in the slots 131 of the connection base 10. Each terminal 30 has a solder portion 33, an upper arm 31 and a lower arm 32. The upper arm 31 defines a folk portion 34 at a front end thereof.

The lid member 20 includes a pair of pivotal shafts 21 at two lateral sides thereof, and a pair of brake shafts 23. Each brake shaft 23 is adjacent to an inner side of each pivotal shaft 21. Each pivotal shaft 21 is pivoted respectively to the sidewalls 120 of the connection base 10.

The latch members 40 are punched via metallic materials and secured respectively to the sidewalls 120 of the connection base 10. Each latch member 40 has a foundation 41 disposed at a bottom face of each sidewall 120, and a latch arm 46 extending from the foundation 41 into the opening 112 of the connection base 10 and further located beneath each brake shaft 23.

Depending on the structure mentioned above, when the flat cable 200 inserts a predetermined location in accordance with the connector structure 100 of the first preferred embodiment, the recess 202 of the flat cable 200 locates beneath a front end of the latch arm 46. When the lid member 20 covers backwards over the expansion portion 130, the brake shafts 23 suppresses the latch arms 46, and front ends of the latch arms 46 engage the recesses 202 of the flat cable 200, respectively. Therefore, the flat cable 200 is secured in the connector structure 100 so as to prevent easy departure from the connector structure 100.

Figure 3:
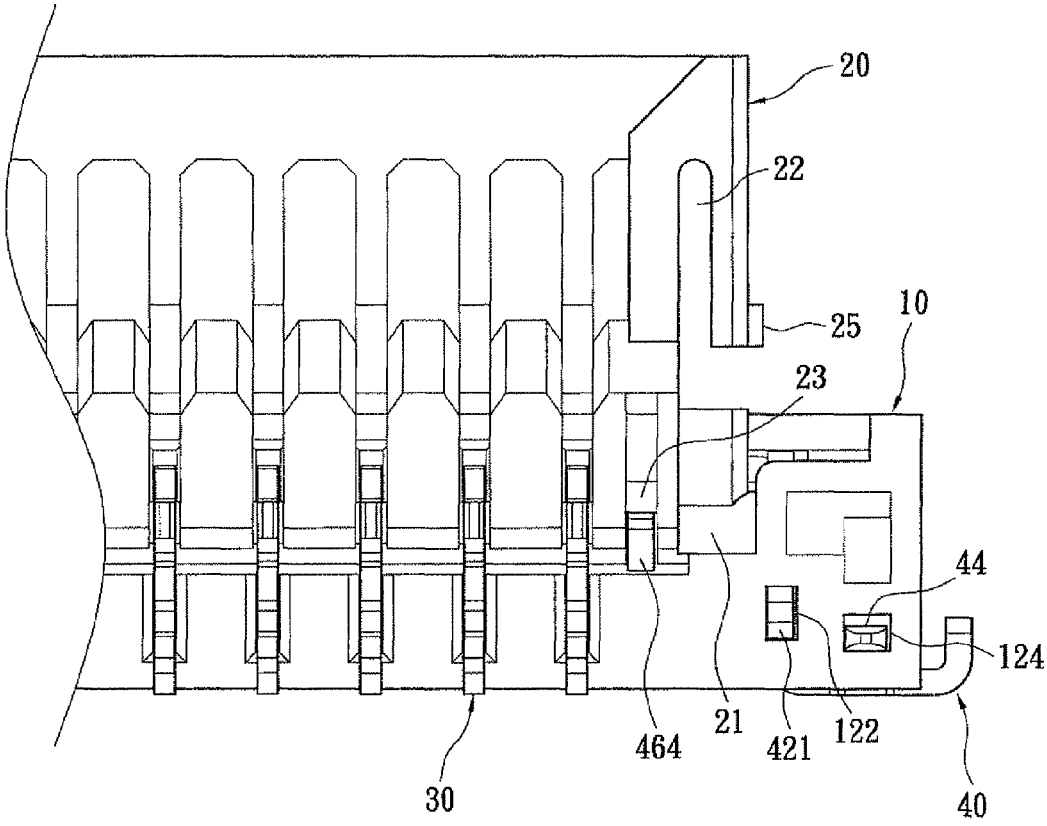
FIG. 3 shows an enlarged rear view of the connector structure in accordance with the first preferred embodiment according to the present invention.
Figure 4:
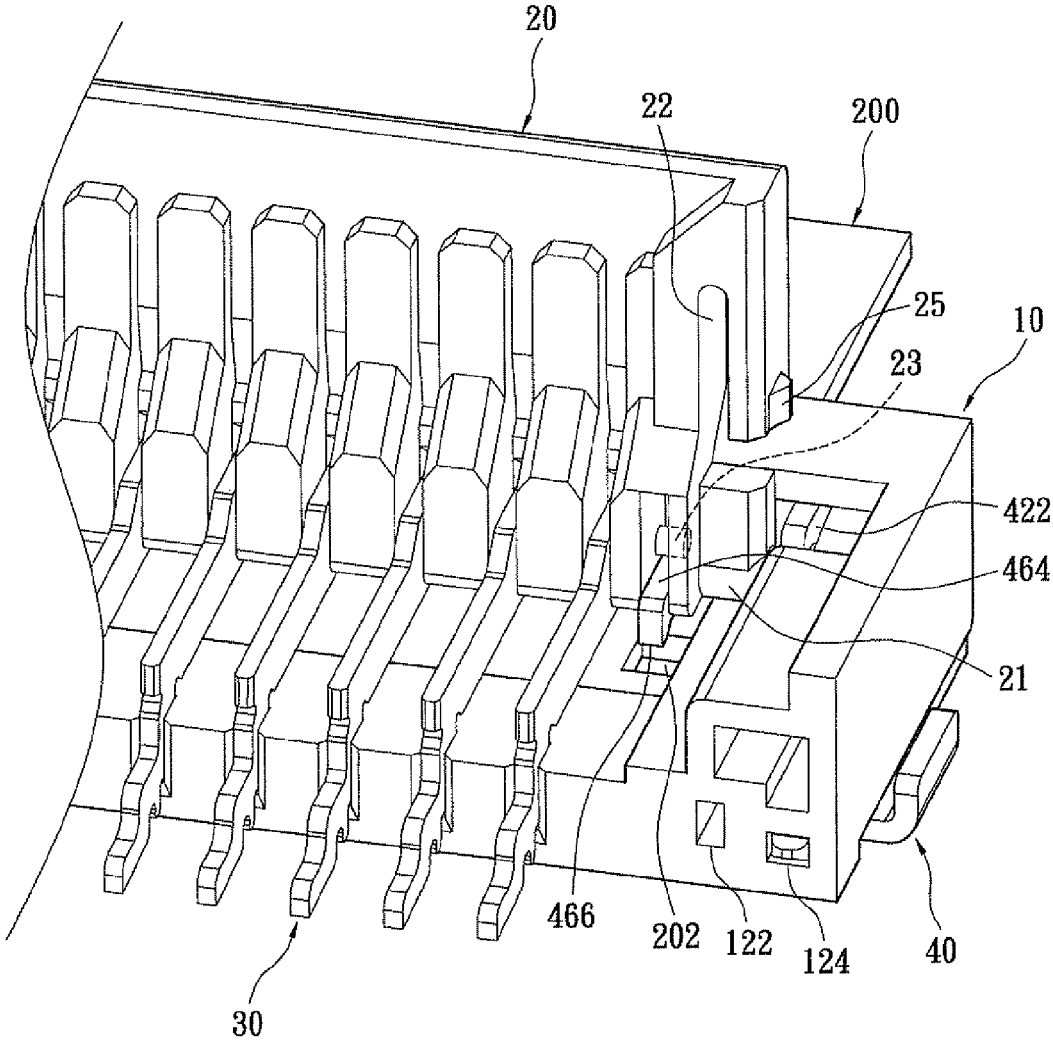
FIG. 4 shows an enlarged perspective view of the connector structure in accordance with the first preferred embodiment according to the present invention.

Here are details regarding the latch members 40 offering means for respectively connecting the sidewalls 120. Each sidewall 120 defines a base slot 121 formed at a bottom face thereof, a reception slot 122 adjacent to an inner side of the base slot 121, and a guide slot 124 dented upwards from the base slot 121. In this case, the reception slot 122 and the guide slot 124 penetrate through the corresponding sidewall 120. The foundation 41 of each latch member 40 is disposed in the base slot 121; each latch member 40 includes a front extrusion arm 44 extending upwards from a rear of the foundation 41 and further stretching horizontally for receiving in the guide slot 124, as illustrated in FIGS. 3 and 4.

Here are details regarding the lid member 20. The lid member 20 includes a pair of protrusions 25 arranged at two lateral sides thereof, a pair of constriction slots 22 dented upwards from a bottom face thereof, and a plurality of interior shafts 24 spaced at intervals at the bottom face thereof and between the two pivotal shafts 21. The brake shafts 23 are arranged between the outmost interior shafts 24 and the two pivotal shafts 21, respectively. When the lid member 20 covers, the constriction slots 22 shrinks inwards so that the protrusions 25 engages to a side face of the sidewalls 120. The lid member 20 further defines a pair of shaft slots 230 for receiving the brake shafts 23. The interior shafts 24 locate between the pivotal shafts 21, and are disposed respectively in the folk portions 34 of the terminals 30. The brake shaft 23 defines a shaft axis being higher than a shaft axis of the pivotal shaft 21, while the lid member 20 is upright.

Here are details regarding the latch members 40. Each latch member 40 has a side block 43 extending upwards from an external edge of the foundation 41, an upright portion 42 extending upwards from an internal edge of the foundation 41, and a fix arm 421 extending backwards from the upright portion 42. The fix arm 421 is secured in the reception slot 122 of each sidewall 120, as illustrated in FIGS. 3 and 4. For connection of the pivotal shaft 21 of the lid member 20, each latch member according to the first preferred embodiment further includes a shaft arm 422 extending upwards from a top of the upright portion 42 and further stretching backwards. The shaft arm 422 claps with the respective one of the pivotal shaft 21 of the lid member 20 so as to prevent the pivot shaft 21 from departing upwards.

The latch arm 46 of each latch member 40 includes a transverse portion 462 extending inwards horizontally from the top of the upright portion 42, and a longitudinal portion 464 extending backwards from a distal end of the transverse portion 462. The longitudinal portion 464 has a buckle portion 466 extending downwards from a distal end thereof, and the longitudinal portion 464 locates beneath the respective one of the brake shafts 23 and at each lateral side of the opening 122. For mating the structure of each latch member 40, each of the sidewalls 120 defines a transverse slot 126 communicating with the reception slot 122 and the opening 112, and the transverse portion 462 of the latch arm 46 is received in the transverse slot 126.

Figure 5:
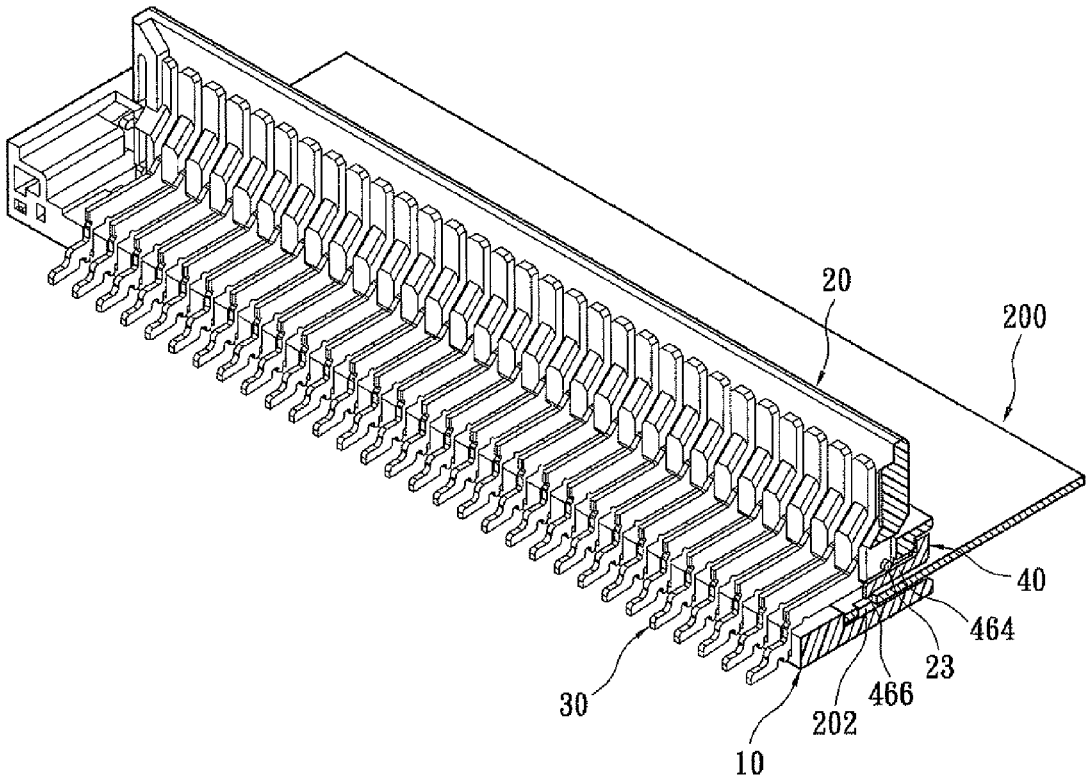
FIG. 5 shows a cross-sectional profile of the connector structure in accordance with the first preferred embodiment according to the present invention.

With respective of FIGS. 4 and 5, an enlarged respective view and a cross-sectional profile of the connector structure of the first embodiment according to the present invention are disclosed. The longitudinal portion 464 locates beneath the corresponding brake shaft 23, and the buckle portion 466 locates over the corresponding recess 202 of the flat cable 200.

Figure 6:
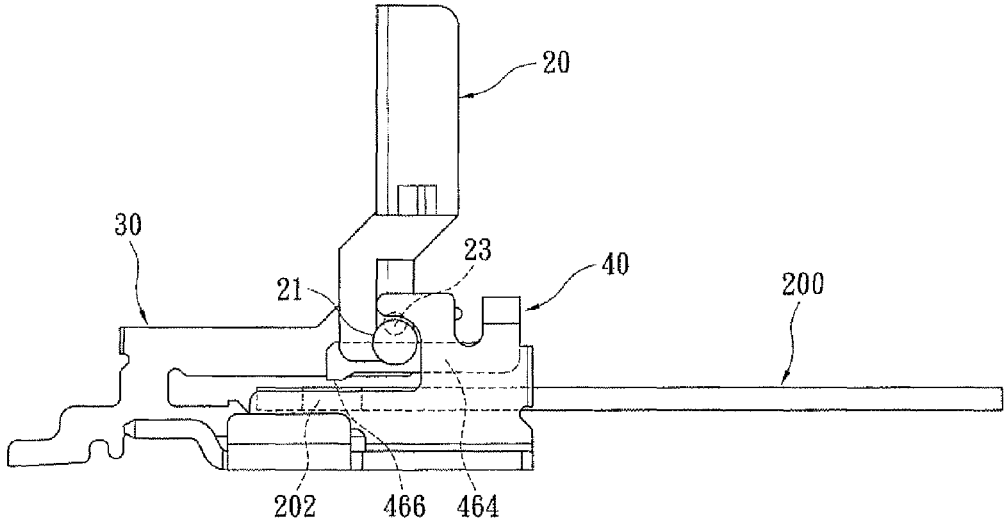
FIG. 6 shows a side view of the connector structure without a connection base, while the lid member is upright, in accordance with the first preferred embodiment according to the present invention.
Figure 7:
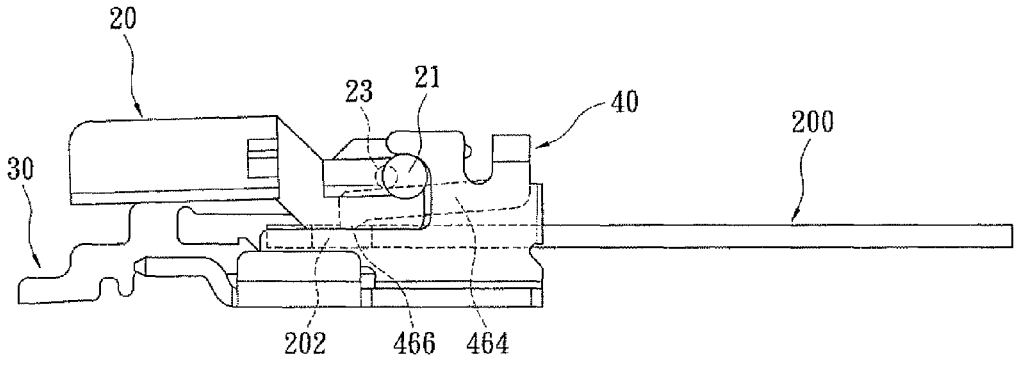
FIG. 7 shows a side view of the connector structure without a connection base, while the lid member covers over, in accordance with the first preferred embodiment according to the present invention.

With respective of FIGS. 6 and 7, sides views of the connector structure without the connection base while the lid member is upright or covers in accordance with the first embodiment of the present invention are disclosed. First, the flat cable 200 is inserted into a predetermined location and the lid member 20 covers backwards then. The brake shafts 23 move downwards and suppress the longitudinal portion 464; buckle portion 466 of the latch arm 46 clasps into the recess 202 of the flat cable 200, so that the flat cable 200 is connected well.

The characteristic in this case is to provide the brake shaft 23 drives the latch arm 46 after the lid member 20 covers over, and to get the engagement between the front end of the latch arm 46 and the recess 202 of the flat cable 200. The approaches for the brake shaft 23 actuating the latch arm 46 is implemented not only via the first preferred embodiment, but also via other embodiments, in which one is exampled as followed.

Figure 8:
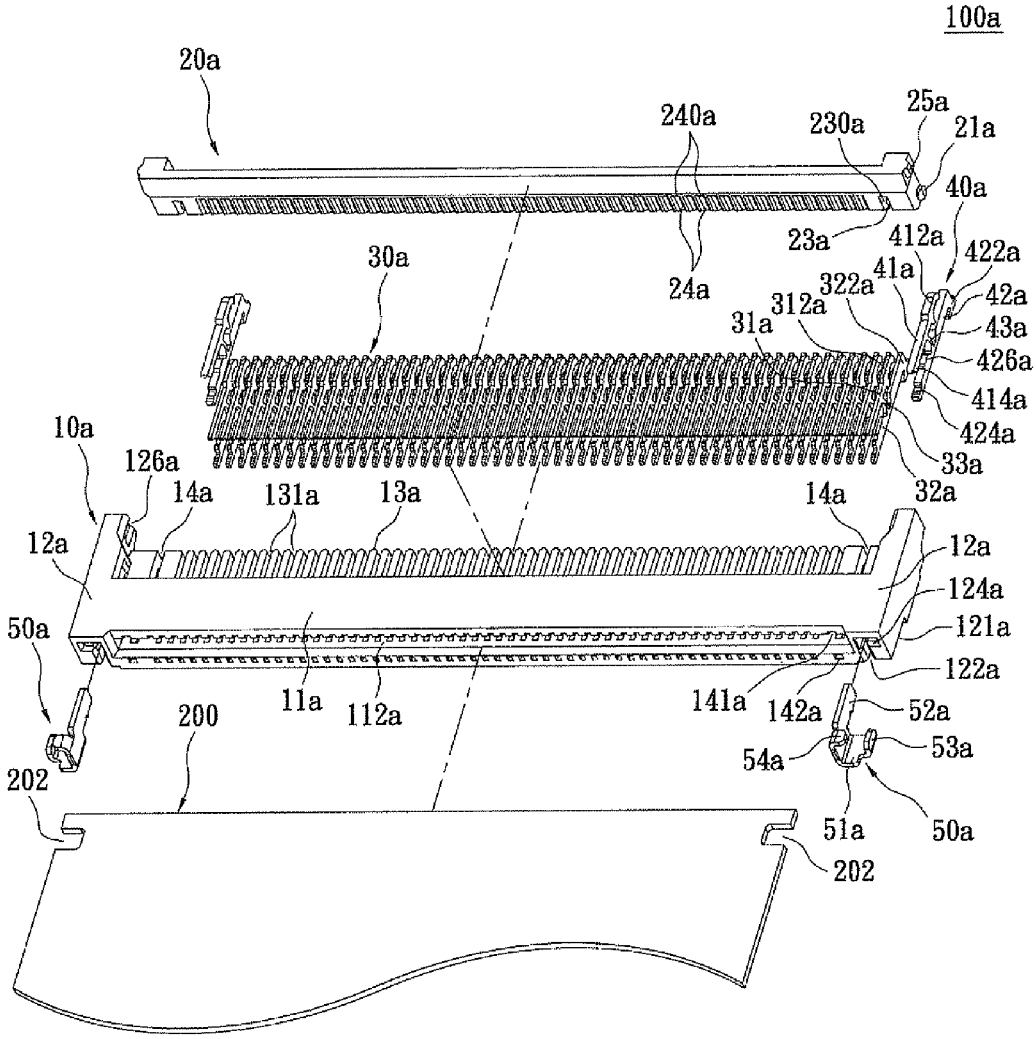
FIG. 8 shows a decomposition view of a connector structure in accordance with a second preferred embodiment according to the present invention.
Figure 9:
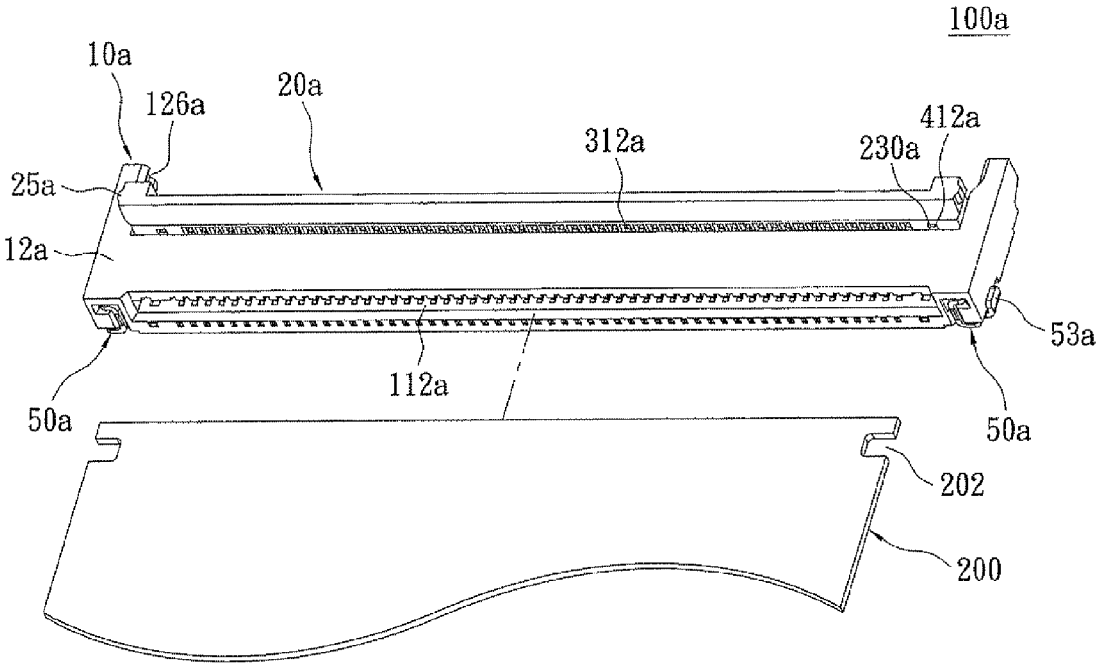
FIG. 9 shows a perspective view of the connector structure before accommodating a flat cable in accordance with the second preferred embodiment according to the present invention.
Figure 10:
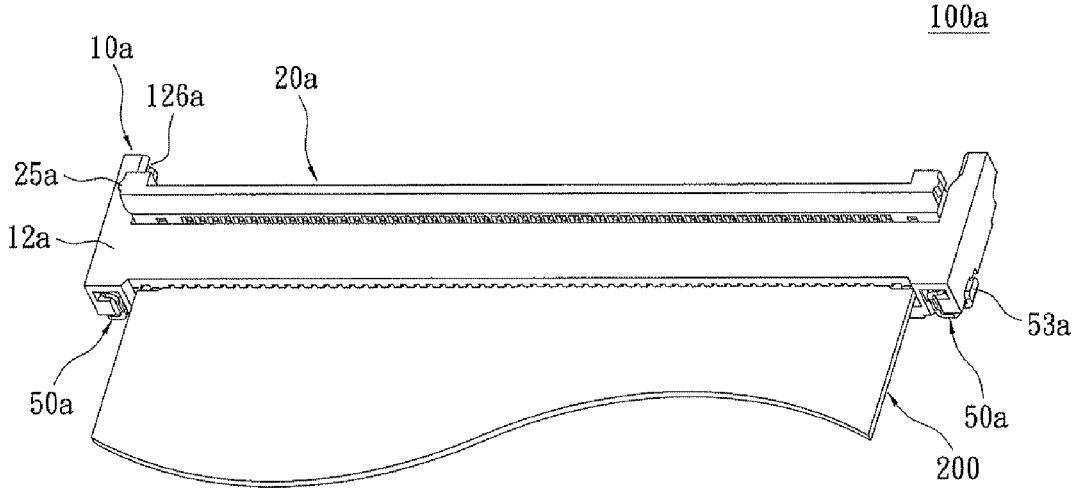
FIG. 10 shows a perspective view of the connector structure after accommodating the flat cable in accordance with the second preferred embodiment according to the present invention.

Referring now to FIGS. 8 to 10, in which a connector structure 100*a* in accordance with a second preferred embodiment according to the present invention is disclosed. The connector structure 100*a* is used for accommodating and electrically connecting a flat cable 200. The flat cable 200 is inserted from a front end of the connector structure 100*a*; the flat cable 200 defines a recess 202 at each lateral side thereof, and has a bottom face exposing a plurality of conductive wires (not shown).

The connector structure 100*a* in accordance with the second preferred embodiment defines an end adjacent to the flat cable 200 as the front end thereof. The connector structure 100*a* includes a connection base 10*a*, a lid member 20*a* pivoted to the connection base 10*a*, a plurality of terminals 30*a* received in the connection base 10*a*, a pair of latch members 40*a* secured to two lateral sides of the connection base 10*a*, and a pair of secure members 50*a* for securing the connection base 10*a* to a printed circuit board (not shown).

The connection base 10*a* has a base portion 11*a*, a pair of sidewalls 12*a* extending backwards from two lateral sides of the base portion 11*a* respectively, an expansion portion 13*a* extending backwards from a bottom of the base portion 11*a*, a plurality of slots 131*a* penetrating through the base portion 11*a* and the expansion portion 13*a*, and a pair of reception slots 14*a* formed by the outmost two slots 131*a* respectively. The base portion 11*a* defines an opening 112*a* for forming a front-end face to accommodate the flat cable 200. The terminals 30*a* are received respectively in the slots 131*a* of the connection base 10*a*. The reception slots 14*a* are divided into an upper slot 141*a* and a lower slot 142*a*.

The lid member 20*a* includes a pair of pivotal shafts 21*a* located at two lateral sides thereof, and a pair of brake shafts 23*a*. Each brake shaft 23*a* is adjacent to an inner side of each pivotal shaft 21*a*. The pivotal shafts 21*a* are arranged in a pair of shaft slots 230*a*. The pivotal shafts 21*a* are pivoted respectively to the sidewalls 12*a* of the connection base 10*a*. Each brake shaft 23*a* is flat-column-shaped. The lid member 20*a* includes a plurality of interior shafts 240*a* spaced at intervals at the bottom face thereof and between the two pivotal shafts 21*a*, and a pair of protrusions 25*a* projected from lateral sides thereof. Each sidewall 12*a* includes a clamp slot 126*a* formed at an internal side face thereof so that each protrusion 25*a* mating with the clamp slot 126*a* for the engagement there between.

The latch members 40*a* are received in the reception slots 14*a* of the connection base 10*a* respectively. Each latch member 40*a* locates at the same vertical face with the corresponding recess 202 of the flat cable 100. Each latch member 40*a* includes a latch arm 41*a*, a base arm 42*a* and a link section 43*a* connecting a mid of the latch arm 41*a* to a mid of the base arm 42*a*. The latch arm 41*a* is arranged in the upper slot 141*a* of the reception slots 14*a*, and the base arm 43*a* is arranged in the lower slot 142*a*. Each brake shaft 23*a* locates between a rear end of the latch arm 41*a* and a rear end of the base arm 42*a*. The latch arm 41*a* has an arc indention 412*a* formed at a bottom face of the rear end thereof, and a clamp portion 414*a* projected from a front end thereof. The clamp portion 414*a* of the front end of each latch arm 41*a* locates over the corresponding recess 202. Each brake shaft is arranged in the arc indentation 412*a*. The base arm 42*a* has a solder portion 422*a* disposed at a rear end thereof in order to solder a printed circuit board (not shown). With respective to FIG. 11, the base arm 42*a* defines an interference portion 424*a* at a front end thereof in order to fix in the lower slot 142*a*. The base arm 42*a* defines a rising portion 426*a* at a mid thereof in order to support a front edge of the flat cable 200.

Depending on the structure mentioned above, when the flat cable 200 covers over in accordance with the connector structure 100*a* of the second preferred embodiment, each brake shaft 23*a* lifts the rear end of the corresponding latch arm 41*a* so that the clamp portion 414*a* of each latch arm 41*a* engages the corresponding recess 202 of the flat cable 100. The link section 43*a* therein works as a fulcrum.

For further strengthens of the connector structure 100*a*, the secure members 50*a* are provided to meet this issue. Each secure member 50*a* includes a foundation 51*a* arranged at a bottom of each lateral sidewall 12*a*, a side block 53*a* extending upwards from an external edge of the foundation 51*a*, and a fix arm 52*a* extending backwards from the foundation 51*a*. The foundation, located at the bottom of each lateral sidewall 12*a*, is soldered to a printed circuit board (not shown). For restraining the vertical movement of the secure members 50*a*, each secure member 50*a* includes a transverse portion 54*a* locating at a front end of the fix arm 52*a* and extending outwards horizontally.

For mating the structure of the secure members 50*a*, each sidewall 12*a* defines a bottom slot 121*a* at a bottom face thereof for receiving the foundation 51*a*, an upright slot 122*a* dented upwards from the bottom face thereof, and a transverse slot 124*a* communicating a top end of the upright slot 122*a* and extending outwards. The fix arm 52*a* is secured in the upright slot 122*a*, and the transverse portion 54*a* is received in the transverse slot 124*a*.

Here are details regarding the terminals 30*a*. Each terminal 30*a* has an upper arm 31*a*, a lower arm 32*a*, and a link section 33*a* connecting a mid of the upper arm 31*a* to a mid of the lower arm 32*a*. The upper arm 31*a* has a solder portion 322*a* disposed at a rear end thereof for soldering a printed circuit board (not shown). The interior shafts 24*a* are disposed respectively between the rear end of the upper arm 31*a* and a rear end of the lower arm 32*a*. The upper arm 31*a* has an arc indention 312*a* formed at a bottom face of the rear end thereof. Each interior shaft 24*a* is received in the arc indention 312*a*.

Figure 11:
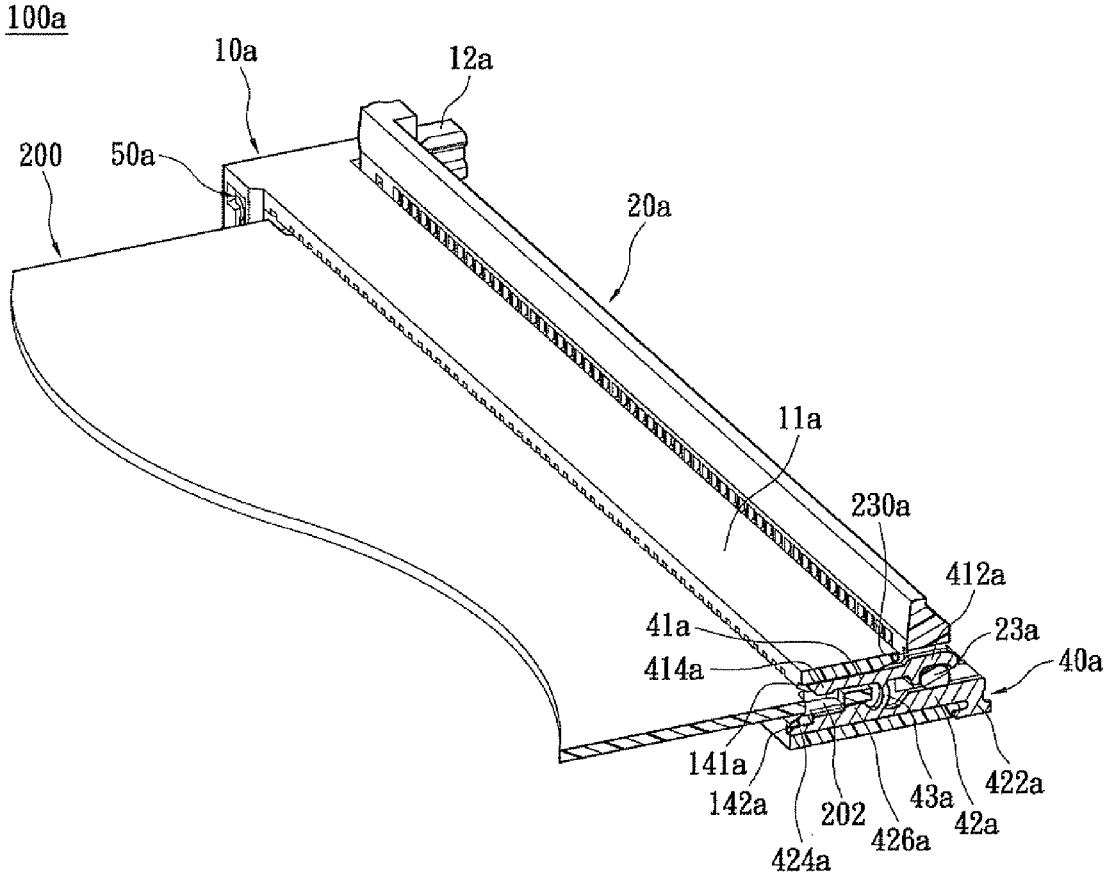
FIG. 11 shows a cross-sectional profile of the connector structure, while the lid member is upright, in accordance with the second preferred embodiment according to the present invention.

With respective to FIG. 11, a cross-sectional profile of the connector structure, while the lid member is upright, and each brake shaft 23*a* is flat-column-shaped resulted from a segment of circle. Each brake shaft 23*a* defines two different diameters and vertical to each other. The lid member 20*a* is upright; each brake shaft 23*a* is at a transverse position and is defined at a lower height.

Figure 12:
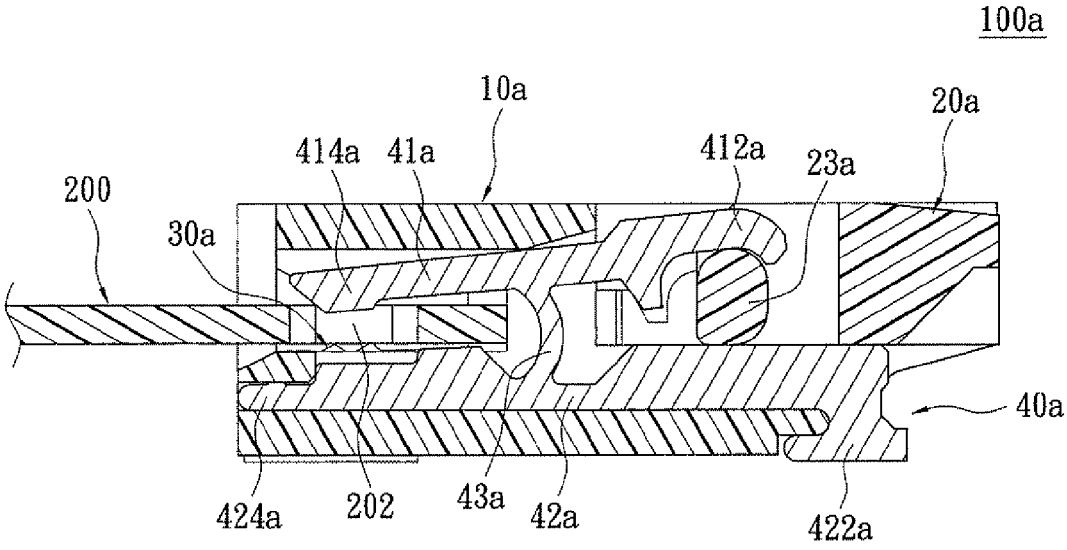
FIG. 12 shows a cross-sectional profile of the connector structure, while the lid member covers over, in accordance with the second preferred embodiment according to the present invention.

With respective to FIG. 12, a cross-sectional profile of the connector structure, while the lid member covers over, and each brake shaft 23*a* is at an upright position and is defined at a higher height. Therefore, each brake shaft 23*a* lifts the rear end of the latch arm 41*a* of each latch member 41*a*, so that the front end of the latch arm 41*a* moves downwards in the recess 202 of the flat cable 200. It brings to strengthens engagement between the cable 200 and the connector structure 100*a*. For the accouter principle thereby, the brake shaft 23*a* is configured as a camshaft, an oval shaft, or the likes.

There are advantages in accordance with the present invention:

First, the structure for securing the flat cable is substantially strong: the latch member 40/40*a* is used to engage with the flat cable 200.

Second, the procedure for secure of the flat cable is simplified: the brake shafts 23 in the first preferred embodiment suppress the latch members 40 in order to engage the flat cable 200, the alignment of the recess 202 to any block is no needs in advance. The brake shafts 23 in the second preferred embodiment pushes the latch members 40*a* to hook the flat cable 200, no alignment in advance is required as well.

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A connector structure, accommodating a flat cable via a front end thereof; wherein the flat cable defines a recess at each lateral side thereof; and the connector comprising:

a connection base having a base portion, a pair of sidewalls extending backwards from two lateral sides of the base portion respectively, an expansion portion extending backwards from a bottom of the base portion, and a plurality of slots penetrating through the base portion and the expansion portion; wherein the base portion defines an opening for forming a front-end face to accommodate the flat cable;

a plurality of terminals received respectively in the slots of the connection base;

a lid member including a pair of pivotal shafts pivoted respectively to the sidewalls of the connection base, and a pair of brake shafts each being adjacent to an inner side of each pivotal shaft; and a pair of latch members being made of metallic materials and secured respectively to the sidewalls of the connection base, wherein each latch member has a foundation disposed at a bottom face of each sidewall, and a latch arm extending from the foundation into the opening of the connection base and further located beneath each brake shaft;

whereby the brake shafts suppresses the latch arms in order to engage the recesses of the flat cable respectively, after the lid member covers over.

2. The connector structure according to claim 1, wherein the lid member includes a pair of protrusions arranged at lateral sides thereof, a pair of constriction slots dented upwards from a bottom face thereof, and a plurality of interior shafts spaced at intervals at the bottom face thereof and between the two pivotal shafts.

3. The connector structure according to claim 2, wherein the brake shafts are arranged between the outmost interior shafts and the two pivotal shafts, respectively.

4. The connector structure according to claim 2, wherein each of the terminals has a solder portion, an upper arm and a lower arm; the upper arm defines a folk portion at a front end thereof; wherein the interior shafts are disposed respectively in the folk portions of the terminals.

5. The connector structure according to claim 1, wherein the brake shaft defines a shaft axis being higher than one of the pivotal shaft, while the lid member is upright.

6. The connector structure according to claim 1, wherein each of the sidewalls defines a base slot formed at a bottom face thereof, a reception slot being adjacent to an inner side of the base slot, and a guide slot dented upwards from the base slot; wherein the foundation of each latch member is disposed in the base slot, each latch member includes a front extrusion arm extending upwards from a rear of the foundation and further stretching horizontally for receiving in the guide slot.

7. The connector structure according to claim 6, wherein each latch member has a side block extending upwards from an external edge of the foundation, an upright portion extending upwards from an internal edge of the foundation, and a fix arm extending backwards from the upright portion and being secured in the reception slot of each sidewall.

8. The connector structure according to claim 7, wherein each of the latch member includes a shaft arm extending upwards from a top of the upright portion and further stretching backwards, the shaft arm claps with the respective one of the pivotal shaft of the lid member.

9. The connector structure according to claim 7, wherein the latch arm of each latch member includes a transverse portion extending inwards horizontally from a top of the upright portion, and a longitudinal portion extending backwards from a distal end of the transverse portion; wherein the longitudinal portion has a buckle portion at a distal end thereof, and the longitudinal portion locates beneath the respective one of the brake shafts and at each lateral side of the opening.

10. The connector structure according to claim 9, wherein each of the sidewalls defines a transverse slot communicating with the reception slot and the opening, and the transverse portion of the latch arm is received in the transverse slot.

11. A connector structure, accommodating a flat cable via a front end thereof; wherein the flat cable defines a recess at each lateral side thereof; and the connector comprising:

a connection base having a base portion, a pair of sidewalls extending backwards from two lateral sides of the base portion respectively, a plurality of slots penetrating through the base portion, and a pair of reception slots formed by the outmost two slots respectively; wherein the base portion defines an opening for forming a front-end face to accommodate the flat cable;

a plurality of terminals received respectively in the slots of the connection base;

a lid member including a pair of pivotal shafts pivoted respectively to the sidewalls of the connection base, and a pair of brake shafts, each being adjacent to an inner side of each pivotal shaft; wherein each brake shaft is flat-column-shaped; and a pair of latch members received respectively in the reception slots of the connection base, wherein each of the latch members locates at the same vertical face with the corresponding recess of the flat cable; each latch member includes a latch arm, a base arm and a link section connecting a mid of the latch arm to a mid of the base arm; a front end of each latch arm locates over the corresponding recess, and each brake shaft locates between a rear end of the latch arm and a rear end of the base arm;

whereby each brake shaft lifts the rear end of the corresponding latch arm so that the front end of each latch arm engages the corresponding recess of the flat cable, after the lid member covers over.

12. The connector structure according to claim 11, further comprising a pair of secure members; each secure member includes a foundation arranged at a bottom of each lateral sidewall, a side block extending upwards from an external edge of the foundation, and a fix arm extending backwards from the foundation; wherein the foundation, located at the bottom of each lateral sidewall, is soldered to a printed circuit board.

13. The connector structure according to claim 12, wherein each secure member includes a transverse portion locating at a front end of the fix arm and extending outwards horizontally.

14. The connector structure according to claim 13, wherein each of the sidewall defines a bottom slot at a bottom face thereof for receiving the foundation, an upright slot dented upwards from the bottom face thereof, and a transverse slot communicating a top end of the upright slot and extending outwards; wherein the fix arm is secured in the upright slot, and the transverse portion is received in the transverse slot.

15. The connector structure according to claim 11, wherein the lid member includes a plurality of interior shafts spaced at intervals at the bottom face thereof and between the two pivotal shafts, and a pair of protrusions arranged at lateral sides thereof; wherein each sidewall includes a clamp slot formed at an internal side face thereof so that each protrusion mating with the clamp slot.

16. The connector structure according to claim 15, wherein each of the terminals has an upper arm, a lower arm, and a link section connecting a mid of the upper arm to a mid of the lower arm; the upper arm has a solder portion disposed at a rear end thereof; wherein the interior shafts are disposed respectively between the rear end of the upper arm and a rear end of the lower arm.

17. The connector structure according to claim 16, wherein the upper arm of each terminal has an arc indention formed at a bottom face of the rear end thereof.

18. The connector structure according to claim 11, wherein the latch arm of each latch member has an arc indention formed at a bottom face of the rear end thereof.

19. The connector structure according to claim 17, wherein the base arm of each latch member has a solder portion formed at a rear end of the base arm for soldering a printed circuit board.

20. A connector structure, accommodating a flat cable via a front end thereof; wherein the flat cable defines a recess at each lateral side thereof; and the connector comprising:

a connection base having a base portion, a pair of sidewalls extending backwards from two lateral sides of the base portion respectively, a plurality of slots penetrating through the base portion, and a pair of reception slots formed by the outmost two slots respectively; wherein the base portion defines an opening for forming a front-end face to accommodate the flat cable;

a plurality of terminals received respectively in the slots of the connection base;

a lid member including a pair of pivotal shafts pivoted respectively to the sidewalls of the connection base, and a pair of brake shafts, each being adjacent to an inner side of each pivotal shaft; and pair of latch members received respectively in the reception slots of the connection base, and each of the latch members includes a latch arm extending over the corresponding recess of the flat cable;

whereby each brake shaft pushes the corresponding latch arm so that the front end of each latch arm engages the corresponding recess of the flat cable, after the lid member covers over.

* * * * *